United States Patent [19]

McBride et al.

[11] 4,364,776

[45] Dec. 21, 1982

[54] RECOVERY OF HEAVY HYDROCARBONS FROM OIL SLUDGE

[75] Inventors: Alistair D. McBride, Wishaw, Scotland; Ian S. Ripley, Middlesbrough, England

[73] Assignee: Emultec Limited, Eaglescliffe, England

[21] Appl. No.: 228,274

[22] Filed: Jan. 19, 1981

[30] Foreign Application Priority Data

Jan. 19, 1980 [GB] United Kingdom ..... 8001862

[51] Int. Cl.[3] ..... B08B 3/02; B08B 9/08

[52] U.S. Cl. ..... 134/10; 134/22.18; 134/40

[58] Field of Search ..... 134/10, 22.18, 22.19, 134/40, 168 R, 169 R

[56] References Cited

U.S. PATENT DOCUMENTS

| | | | |
|---|---|---|---|
| 1,722,211 | 7/1929 | Guardino | 134/22.18 |
| 2,020,350 | 11/1935 | Bertschinger | 134/168 R X |
| 2,240,227 | 4/1941 | Saussure | 134/168 R |
| 2,647,639 | 8/1953 | Grein | 134/168 R X |
| 3,025,190 | 3/1962 | Groom et al. | 134/22.19 X |
| 3,121,027 | 2/1964 | Galanor | 134/168 R X |
| 3,364,893 | 1/1968 | Maddock | 134/10 X |
| 3,436,263 | 4/1969 | Strenkert et al. | 134/22.19 |
| 3,535,160 | 10/1970 | Arger | 134/22.19 |
| 4,015,613 | 4/1977 | Papworth | 134/168 R X |

FOREIGN PATENT DOCUMENTS

| | | | |
|---|---|---|---|
| 951618 | 3/1964 | United Kingdom | 134/22.19 |

*Primary Examiner*—Marc L. Caroff

*Attorney, Agent, or Firm*—Mason, Fenwick & Lawrence

[57] ABSTRACT

Oil sludge (15) formed within a storage container (10) is removed by penetrating tubular lances (20) into the sludge body (15) and then pumping dispersant chemicals borne by a water jet through the lances (20) into the sludge body (15) with continuous drawing off and recirculation of emulsified fractions under pressure. The sludge body (15) breaks down both physically and chemically to form a pumpable fluid which is drained and mixed with a larger volume of liquid oil to allow dispersion of the hydrocarbonaceous content of the emulsified fluid as a suspension in the oil volume allowing the water to settle out of the mixture, the settled water layer being thereafter drawn off. This oil mixture is then processed in the process plant. The dispersant chemicals emulsify or form coloidal suspension or solution of the hydrocarbonaceous content of the sludge body (15) in water.

5 Claims, 5 Drawing Figures

RECOVERY OF HEAVY HYDROCARBONS FROM OIL SLUDGE

This invention relates to the recovery of heavy hydrocarbons from the sludge which forms when oil, either crude or partly refined, is left standing in a container.

Crude or partly refined oil is usually stored in storage tanks and it is well known that the higher or lighter oil fractions form layers above the heavier fractions. In the course of time these heavier fractions become more and more viscous and form a sludge. Similarly sludges are formed in other containers, such as oil-filled pipelines where the oil is left standing for a long time. These sludges play no useful part in the oil-refining and processing plant and in fact reduce the available storage capacity and processing rate. Where the sludge is formed in an oil tank its presence may affect the repeated measurements which are taken of the stored volume of crude or partly processed oil resulting in financial penalties being paid by the proprietor. Furthermore if the tank is of the floating roof type the sludge may form an uneven upper surface resulting in harmful stresses on the floating roof structure when the latter is resting on its legs.

Hitherto known methods of sludge removal include:

(1) Removal of the readily pumpable liquid oil fractions followed by manual excavation of the sludge mass using hand tools.

(2) Circulation of hot higher-fraction oils and solvents to dissolve at least the lighter sludge fractions.

These known methods have not proved satisfactory. The first method is extremely time-consuming, the operatives are required to work in an unhealthy and dangerous environment and large volumes of waste are excavated requiring careful and costly disposal. The second method is also time-consuming, highly energy intensive, ineffective as regards removal of the heaviest of the sludge fractions, and can only be practised with safety in installations specifically designed for such extreme thermal stressing.

We have noted that the problem of dispersing oil in water has received increased attention in recent years due to the requirement to disperse oil spillages in sea water, one effective method of achieving such dispersal being by the use of dispersant chemicals such as are described in U.K. patent specification No. 1,459,104. We have attempted sludge removal from an oil tank by circulating such dispersant chemicals over the sludge body but we have not found it to be satisfactory. We believe this to be because the dispersant is not brought into intimate contact with the heaviest of the fractions in the sludge body.

We have however surprisingly discovered that by penetrating tubular lances into the sludge body and then pumping such dispersant chemicals borne by a water jet through the lances into the sludge body and by continuously drawing off and recirculating the emulsified oil fractions under pressure, the sludge body can be broken down both physically and chemically so as to form a pumpable mass which can be drained from the container in which the sludge body was formed.

Accordingly the present invention provides a method of removing a hydrocarbonaceous sludge body from a container, comprising the steps of penetrating one or more tubular lances into the sludge body, pumping into the sludge body by way of the tubular lances dispersant chemical borne by a water jet, the dispersant chemical being emulsifiable in water, continuously drawing off the emulsified hydrocarbonaceous fractions from the surface of the sludge body and recirculating these fractions under pressure by way of the tubular lances into the sludge body.

Preferably the dispersant chemical contains alkyd resin and conveniently is prepared in the manner described in any one of the examples recited in U.K. patent specification No. 1,459,104.

Conveniently the drawn off emulsified hydrocarbonaceous fractions are subjected to a mechanical process to reduce the size of the solids content prior to being recirculated under pressure through the tubular lances. The recirculated material may also be subjected to a controlled amount of heating. Because the heated material is recirculated into the sludge body the heat is dissipated therein relatively quickly and the installation is not subjected to extreme thermal stressing.

Conveniently prior to the dispersant chemical being pumped into the sludge body the higher fractions of the sludge body are removed by washing with crude or gas oil.

The present invention also provides a method of recovery of heavy hydrocarbons from the sludge which forms when oil is left standing in a container, comprising emulsifying the sludge body by the use of water and dispersant chemicals which are emulsifiable in water, mixing the emulsified fluid with a larger volume of oil so as to allow dispersion of the hydrocarbonaceous content of the emulsified fluid as a suspension in the oil volume, allowing the water to settle out of the mixture, and thereafter drawing off the settled water layer.

Preferably the volume of oil with which the emulsified fluid is mixed is contained in a container into which the emulsified fluid is pumped to achieve said mixing. Conveniently the oil is crude oil or gas oil.

The present invention also provides a method of processing in a processing plant oil housed in a container which comprises the step of recovering the heavy hydrocarbons from the sludge which forms when oil is left standing in the container by the use of dispersant chemicals which are emulsifiable in water, and processing in the process plant the recovered hydrocarbon/-chemical mixture when suspended in an oil carrier, the dispersant chemicals being selected from the group which is compatible with the processing plant.

Conveniently the dispersant chemical is one of the formulations recited in U.K. patent specification No. 1,459,104.

The present invention also provides apparatus for effecting emulsification of a hydrocarbonaceous sludge body in a container, comprising a tank for storage of dispersant chemical, a pump having its inlet connected to a pipe for drawing off emulsified fluid from the surface of the sludge body in the container, a plurality of narrow bore lances for penetrating into the sludge body in the container and each lance connected to the pump outlet, means providing a supply of water, and valve means interconnecting the storage tank and the water supply means with the pump inlet whereby dispersant chemical and/or water can be pumped under pressure along the lances and drawn off emulsified fluid recirculated to the sludge body under pressure through said lances.

The present invention also provides an oil storage tank the wall of which comprises an opening with an externally removable plate thereover, the tank being modified by removal of the removable plate and replacement thereof by a plate containing a plurality of glanded nozzles the nozzles being sized to retain in a fluid-tight manner the draw-off pipe and the narrow bore lances of the preceding paragraph.

An embodiment of the present invention will now be described by way of example with reference to the accompanying drawings, in which FIG. 1 is a plan view of a storage tank with sludge recovery apparatus connected thereto;

Figure 1:
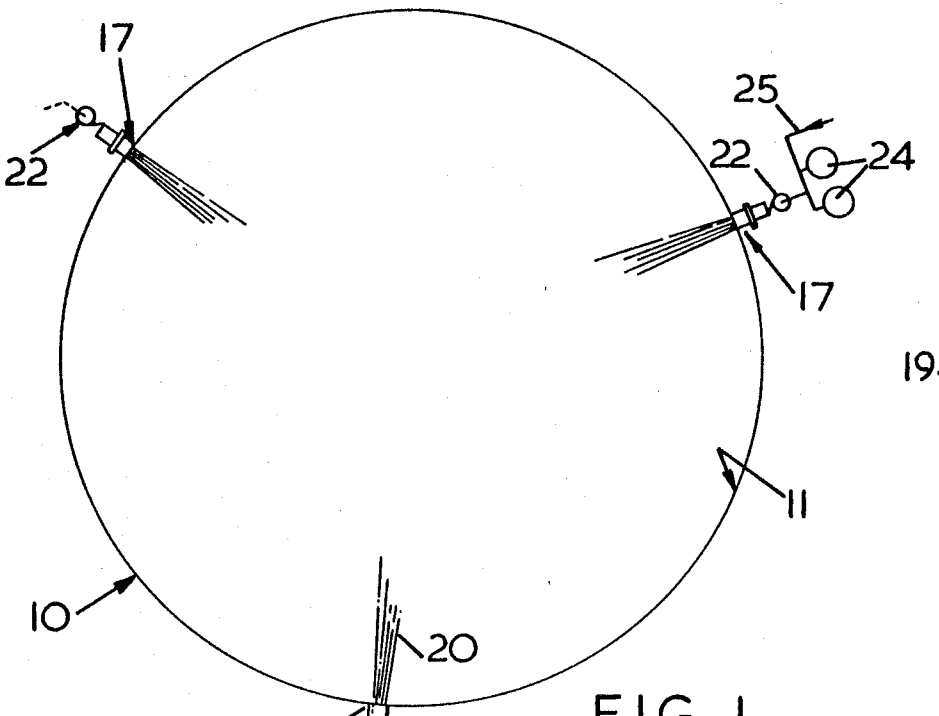
Figure 3:
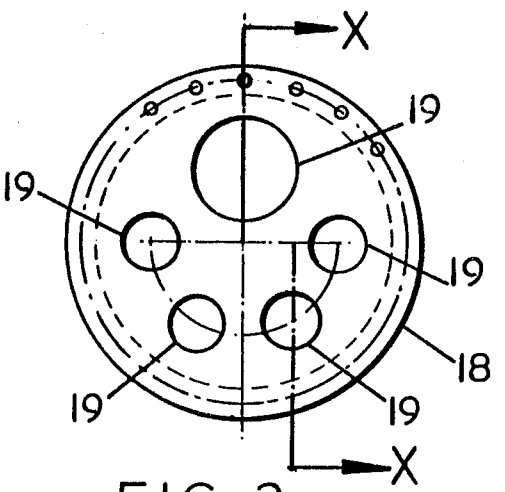
FIG. 3 illustrates a glanded plate used in FIG. 1.
Figure 2:
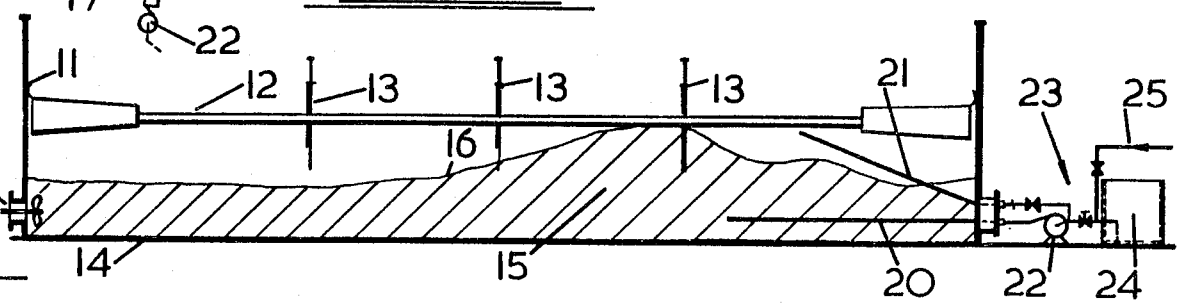
FIG. 2 is an elevational cross-section of the tank of FIG. 1.

In FIGS. 1 and 2 of the drawings an oil storage tank 10 is formed by a peripheral wall 11 and a floating roof 12 which has legs 13. Within the tank 10 adherent to the floor 14 thereof is a sludge body 15 which is to be removed. For this purpose the maximum volume of pumpable oil within the tank is removed by pumping so that the roof 12 assumes the position shown in FIG. 2. By means of access through the roof 12, conveniently at the legs 13, the profile of the sludge surface 16 is determined and samples of the sludge are withdrawn for chemical analysis. With the profile of the sludge surface 16 determined several access points 17 in the wall 11 of the tank 10 are selected at which there are existing openings with externally removable cover plates. These openings may be manholes or, as in FIG. 2, a mounting for a conventional equipment such as an agitator or mixer. The existing cover plates are removed by releasing the bolts securing these plates in position and are replaced by special plates 18 (FIG. 3) containing a plurality of glanded nozzles 19. Removal of the existing plates is possible either because they lie above the surface 16 of the sludge body 15 or if they lie below the surface 16 a temporary cover plate is slipped between the skirt of the floating roof 12 and the inner surface of the wall 11 so that there is minimal spillage from the tank 10 during this procedure. The plates 18 are positioned around the wall 11 of tank 10 in spaced locations and permit entry of tubular lances 20 of relatively narrow bore into the tank 10 within the body 15 of sludge as indicated diagrammatically in FIG. 2 so that the ends of the lances 20 lie in the vicinity of the peak of the surface 16. Conveniently the lances 20 are made of a non-corrosive plastics material such as ABS formed in sections so that the length of each lance can be increased or decreased as desired. For example each lance section may be internally screw-threaded at one end and externally screw-threaded at the other end, the outer diameter of the lance throughout its length being substantially constant so that the lance is a fluid-tight fit in the pertaining glanded nozzle 19.

A relatively large-diameter suction pipe 21 is entered through the pertaining glanded nozzle 19 in each plate 18 and is directed through the sludge body 15 to draw off pumpable fluids gathering on the surface 16. At each plate 18 the lances 20 and the suction pipe 21 are connected to a pump 22, via valved pipework 23, as is a tank 24 containing dispersal chemical and a water supply pipe 25.

Figure 5:
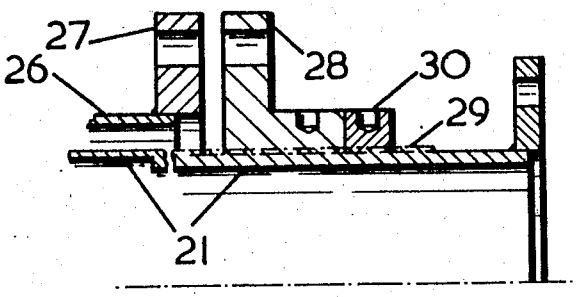
FIG. 5 is a sectional view of an alternative form of nozzle arrangement.
Figure 4:
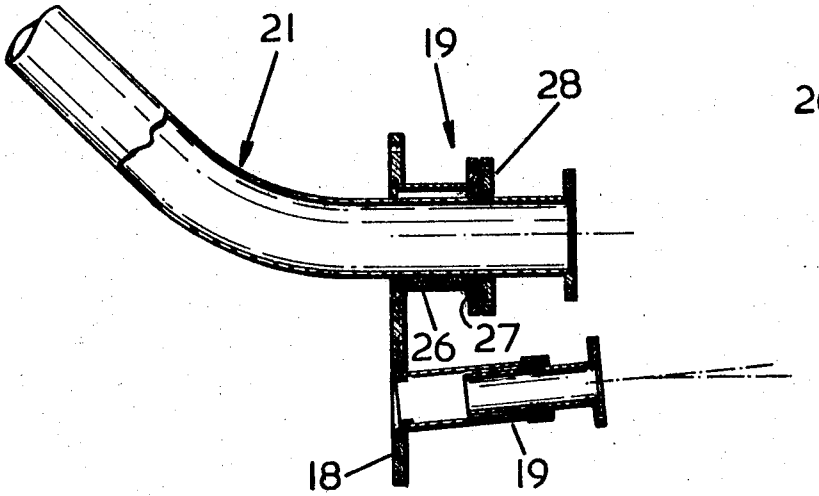
FIG. 4 is a sectional view of the plate of FIG. 3 showing the glanded nozzles in greater detail.

The glanded nozzle 19 which accommodates the suction pipe 21 is formed by a stand-off pipe 26 (FIG. 4) welded at one end to the plate 18 and at the other end to a flange 27. The suction pipe 21 is of fixed length terminating at the plate 18 in a metal section which includes a bend or elbow which incorporates a flange 28 which can be bolted to flange 27 in any one of a number of orientations in order that the orientation of pipe 21 within the tank can be varied in steps to locate the end of suction pipe 21 in a desired position. The space formed between pipe 21 and the stand-off pipe 26 includes packing (not shown) so that the pipe 21 is retained in the nozzle 19 in a fluid-tight manner. In order to provide for continuous positional adjustment of the end of suction pipe 21 within the oil tank the flange 28 may be mounted on the pipe 21 by means of screw threads 29 (FIG. 5) and a locking ring 30. Thus the flange 28 may be permanently secured to nozzle flange 27 and adjustment of the pipe 21 provided by releasing the engagement of the locking ring 30 with the flange 28 and thereafter rotating the pipe 21 to the required position.

The composition of the dispersal chemical is determined from the previously taken sample of the sludge and is suited to the composition and physical characteristics of the sludge and the down-stream oil-processing plant in which the emulsified sludge will ultimately be used.

By way of example the dispersal chemical may be formulated as follows:

An alkyd resin (A) is prepared from pentaerythritol, glycerol, polyethylene glycol (molecular weight Mn 600), trimellitic anhydride and coconut fatty acids in a molar ratio of 0.6:0.6:1.2:1.2:3.0 respectively so as to give a polyethylene glycol content of 40% by wt. The resin had an acid value of 18 to 22 mg KOH/g, and a (POH PA)e value of 1.0.

A second alkyd resin (B) was prepared in the same manner replacing the coconut oil fatty acids by soyabean fatty acids and in this instance the polyethylene glycol content was 50% by wt.

Using resins A and B, the following formulation was blended:

| | |
|---|---|
| (1) | Resin A 6 parts by wt (as a 75% solids solution in white spirit) |
| (2) | Resin B 4 parts by wt (as a 95% solids solution in white spirit) |
| (3) | *Teefroth AN (reaction product of propylene oxide and methanol, containing an average of 3.7 molecules of propylene oxide per molecule of methanol) 20 parts by wt. |
| (4) | NP6 (6 mole ethylene oxide alkoxide derivative of nonyl phenol) 10 parts by wt. |
| (5) | Heavy aromatic hydrocarbons 60 parts by wt. |

*Registered trademark of Imperial Chemical Industries.

To effect removal of the sludge body 15 from the tank 10 the dispersal chemical is pumped into the body 15 through lances 20 borne on a water jet resulting in partial emulsification of the body 15. The emulsified liquids gather on the surface 16 where they are collected by suction pipe 21 and recirculated along the lances 20 under the pressure imposed by the pump 22. This process is repeated continuously utilising a predetermined volume of dispersal chemical for the estimated volume of the sludge body 15 and thereafter water is added to the recirculating fluids, the recirculation being continuous until such time as the entire body 15 is emulsified and is in the form of a pumpable fluid, as determined by intermittent tests made by dipping through one of the access points in the roof 12.

By way of example it is estimated that for 2,000 tons (tonnes) of sludge about 50 tons (tonnes) of dispersal chemical and 7,000 tons (tonnes) of water is required using a pump with an output pressure of about 50 psig. (3.5 bar). Conveniently the suction pipe 21 is about 6 inches (15 cm) diameter and there are four lances 20 each about 4 inches (10 cm) in diameter, the lance outlets being of reduced diameter, for example 2 inches (5 cm) in diameter. The wall thickness of the suction pipe and of the lances conveniently is about 0.5 inches (1 cm) and each lance outlet incorporates a non-return valve mechanism to prevent ingestion of sludge as the lance is entered into the sludge body 15. The suction inlet to the pump 22 may incorporate a device for reducing the size of solids transmitted through the pump and a heater may be connected to the pipework 23 to raise the temperature of the recirculated fluids to about 30° C.

When the sludge body 15 is completely emulsified the emulsified fluid is pumped by way of an existing outlet in the tank 10 to be mixed with a larger volume of oil stored in another storage tank (not shown) as a result of which the hydrocarbonaceous content of the emulsion is dispersed in the stored oil and retained in suspension therein whilst the water content of the emulsion settles out and can be drawn off and disposed of as clean effluent. The stored oil containing the emulsified sludge and chemical in suspension is then available for use as raw material in the down-stream oil processing plant. During the pumping out of the cleaned tank it is desirable to maintain the pumps 22 in operation in order to prevent the sludge settling out of the emulsified fluid.

It will be understood that various modifications may be made to the embodiment within the broader concepts of the invention. For example the invention may be practised where the stored oil is contained in a lagoon or underground cavern the boundary being defined by natural rather than man-made formations. In this case it is clearly not practical to enter the lances through the side wall of the container but the invention may be practised by directing the lances into the sludge body from any direction—conveniently from above. Furthermore the sludge need not be formed from crude mineral oil since other oils, such as heavy fuel oil and fish oil, give rise to sludges which can be treated similarly. The dispersant chemical may be any one or a mixture of polymeric surfactants in an oxygenated alyphatic solvent.

Where the invention is practised on a sludge body within a closed oil storage tank the entire recovery process can be carried out without the need for operating personnel to enter the tank; a gas-free atmosphere within the tank can be provided on completion of the process; spillages of hydrocarbonaceous material in the vicinity of the tank is minimal; and the effluent water after completion of the process is sufficiently clean for disposal through the normal refinery effluent treatment system. The water used in the recovery process may be either fresh or salt water and because the process is water-based the fire risk arising from the invention is minimal. Economically, the invention permits recovery of the sludge body in a form which is usable in the oil-processing plant and the down-time of the tank being cleaned is only one third or one quarter that required of the prior art manual method.

We have used the term 'emulsifiable' herein in relation to the dispersability in water of the dispersant chemical to indicate that the dispersant chemical is substantially uniformly dispersable in the water in the form of a colloidal suspension or a solution.

What is claimed is:

1. A method of fluidising a non-pumpable hydrocarbonaceous sludge body deposited by an oil having a substantial heavy hydrocarbonaceous content when such oil is left standing in a bulk-storage container, said method comprising the steps of penetrating one or more substantially rigid tubular lances into the sludge body, physically and chemically breaking down the sludge body by pumping into the sludge body by way of the tubular lances dispersant chemical borne by a water jet, said dispersant chemical being present in the water jet in an amount sufficient to form emulsified hydrocarbonaceous fractions on the surface of the sludge body, the dispersant chemical being emulsifiable in water, continuously drawing off the emulsified hydrocarbonaceous fractions from the surface of the sludge body and recirculating these fractions under pressure by way of the tubular lances into the sludge body.

2. The method claimed in claim 1, wherein the drawn off emulsified hydrocarbonaceous fractions are subjected to a mechanical process to reduce the size of the solids therein prior to being recirculated under pressure through the tubular lances.

3. The method claimed in claim 1, wherein the recirculated material is subjected to a controlled amount of heating.

4. The method claimed in claim 1, comprising continuing the steps of claim 1 until the sludge body and dispersant chemical form an emulsified fluid and thereafter mixing the emulsified fluid with a larger volume of oil so as to allow dispersion of the hydrocarbonaceous content of the emulsified fluid as a suspension in the oil volume, allowing the water to settle out of the mixture, and thereafter drawing off the settled water layer.

5. The method as claimed in claim 4, wherein the volume of oil with which the emulsified fluid is mixed is contained in a container into which the emulsified fluid is pumped to achieve said mixing.

* * * * *